US008333277B2

(12) United States Patent
Mowe et al.

(10) Patent No.: US 8,333,277 B2
(45) Date of Patent: Dec. 18, 2012

(54) PAINT ROLLER SLEEVE STORAGE CONTAINER

(76) Inventors: William B. Mowe, Lawrenceville, GA (US); Kelly L. Mowe, Lawrenceville, GA (US)

( * ) Notice: Subject to any disclaimer, the term of this patent is extended or adjusted under 35 U.S.C. 154(b) by 0 days.

(21) Appl. No.: 12/804,124

(22) Filed: Jul. 14, 2010

(65) Prior Publication Data

US 2010/0282628 A1 Nov. 11, 2010

Related U.S. Application Data

(63) Continuation-in-part of application No. 12/456,454, filed on Jun. 17, 2009, now Pat. No. 7,823,724, which is a continuation-in-part of application No. 11/472,092, filed on Jun. 21, 2006, now abandoned.

(60) Provisional application No. 61/335,242, filed on Jan. 4, 2010.

(51) Int. Cl.
*B65D 85/00* (2006.01)

(52) U.S. Cl. ..... 206/361; 220/780; 220/789

(58) Field of Classification Search ..... 215/306; 220/375, 780, 254.1; 206/361, 15.2, 15.3
See application file for complete search history.

(56) References Cited

U.S. PATENT DOCUMENTS

| | | | | | |
|---|---|---|---|---|---|
| 3,181,725 | A * | 5/1965 | Friedl | 220/293 |
| 3,623,179 | A * | 11/1971 | Roth | 15/104.001 |
| 4,201,311 | A * | 5/1980 | Underwood | 220/780 |
| 4,467,533 | A * | 8/1984 | Sica | 34/58 |
| 4,520,926 | A * | 6/1985 | Nelson | 206/366 |
| 4,738,358 | A * | 4/1988 | Kehl | 206/207 |
| 5,044,512 | A * | 9/1991 | Giancaspro et al. | 220/709 |
| 5,709,301 | A * | 1/1998 | Couch et al. | 206/361 |
| 6,063,340 | A * | 5/2000 | Lewis et al. | 422/549 |
| 6,085,931 | A * | 7/2000 | Sadow | 220/375 |
| 7,540,380 | B2 * | 6/2009 | Kohs et al. | 206/361 |
| 2005/0035124 | A1 * | 2/2005 | Smith et al. | 220/254.1 |
| 2005/0067417 | A1 * | 3/2005 | Sanders et al. | 220/324 |
| 2006/0096987 | A1 * | 5/2006 | Wry | 220/375 |
| 2007/0017836 | A1 * | 1/2007 | Kohs et al. | 206/361 |

* cited by examiner

*Primary Examiner* — Steven A. Reynolds
*Assistant Examiner* — King M Chu
(74) *Attorney, Agent, or Firm* — RIchard B. Klar, Esq.; Law Office of Richard B. Klar

(57) ABSTRACT

A storage container for paint roller sleeve includes a lid of a container in which the lid of the container has a hole in its center and a slit that extends radially to the circumferential edge of the lid to permit the roller frame to be remain attached to the roller sleeve while the roller sleeve is housed within the container via this slit. A strap holds at one end a plug for insertion into the hole in the center of the lid and at the other end of the strap a hinge fastens the strap to the lid.

10 Claims, 10 Drawing Sheets

PAINT ROLLER SLEEVE STORAGE CONTAINER

RELATED APPLICATIONS

The present application is a continuation in part of patent application Ser. No. 12/456,454 filed Jun. 17, 2009 now U.S. Pat. No. 7,823,724 which is a continuation in part of patent application Ser. No. 11/472,092 filed on Jun. 21, 2006 now abandoned and claims priority under 35 U.S.C. 120. This is also a nonprovisional application of provisional application Ser. No. 61/335,242 filed on Jan. 4, 2010 by Mowe, et al. for which priority is claimed under 35 U.S.C. 119(e).

BACKGROUND OF THE INVENTION

During a standard workday a painter may use one or more paint roller sleeves. Further, in many jobs more than one coat of paint is required. Moreover, if the job is not finished prior to a lunch break or at the end of the workday, the sleeve must be cleaned or discarded. There is a need for a device in which a freshly used, yet to be cleaned paint roller sleeve can be stored overnight, ready for reuse the next day, week or month or anytime in the future including for touch-up paint jobs.

SUMMARY OF THE INVENTION

The object of this invention is to provide a container for a just used paint roller sleeve in which it can be stored and kept in such a condition that can be used again for the same color paint, without first being cleaned. In addition, the cap or lid has a hole and a radially extending slit that permits the roller frame to remain attached to the roller when the roller is inserted and held in the closed container. An additional object of this invention is to provide means for removing a wet paint sleeve from the roller without the painter's hand, whether gloved or otherwise, coming into direct contact with the sleeve.

In accordance with the present invention, there is provided an improved storage container which comprises a generally cylindrical tubular structure having a thin wall made of a flexible, resilient plastic and at least one pleated wall section joined thereto. Formed of a hinged-type plastic, the pleated wall section can be pressed inwardly by hand. When the pleated wall section is so pressed, teeth-like projections on its inside surface are brought into contact with any paint roller sleeve housed temporarily within the storage container and can be used to grip the sleeve firmly.

Means for keeping the paint roller sleeve from resting on the bottom surface of the container preferably includes a standoff. The height of the standoff determines the depth of the reservoir defined by the container for receiving excess paint, which drains from the sleeve during storage.

The upper portion of the tubular structure terminates upwardly in an opening for receiving the sleeve and preferably tapers outwardly, forming a funnel to facilitate insertion of the sleeve into the container and to capture any paint dripping from the sleeve which might otherwise drip outside the container during the insertion process.

Longitudinal ribs which extend inwardly from the inner walls of the tubular structure help to center the sleeve within the container and keep the sleeve, regardless of thickness of its nap, from rattling around in the container. In one embodiment, the ribs may be rounded off at proximate with the opening in the tubular structure so as to help guide the sleeve into the container. In another embodiment, the ribs extend upward from the bottom of the container to approximately half the length of the container.

In a typical use, the just used sleeve while still on the roller is inserted into the storage container. Next the user grasps the sides of the container and presses the pleated wall section inwardly, in such a way that its teeth-like projections engage the roller with sufficient force to hold it while the roller is being slipped out of the sleeve. The container is then closed with a snap-on cap or the like forming an airtight closure which keeps the paint from drying on the sleeve, even after a long storage. To reuse the sleeve, the cap is removed and the roller is inserted into the sleeve. The user is ready to proceed with the paint work.

The cap is preferably attached to the outer walls of the container by a strap which has sufficient length that when the cap is in the closed position, a loop is formed in the strap that can be used for hanging the storage container.

Further, there is provided a section on the outer walls of the container for identification of the paint residual on the sleeve stored there within.

It is further desired to provide an embodiment in which the container has flutes that serve to center the roller within the container and in which the flutes have angled top and bottom surfaces with ends that when the container is pressed inward serve to cut into the sleeve of the roller and hold it in place when removing the handle.

PREFERRED DETAILED DESCRIPTION OF THE PREFERRED EMBODIMENTS

Figure 1:
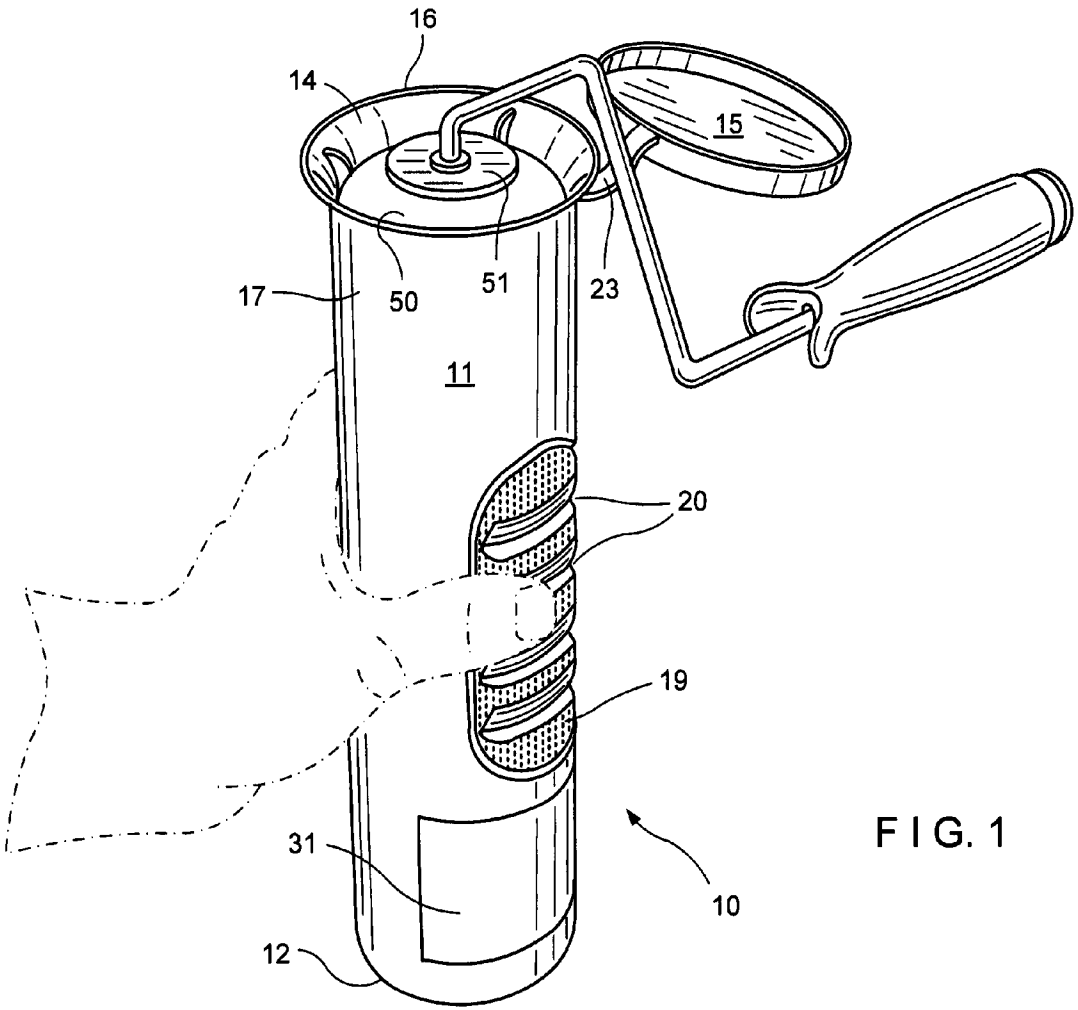
FIG. 1 is a perspective view of a paint roller sleeve storage container according to a first embodiment of the present invention, the storage container being shown holding a paint roller sleeve still mounted on its roller.

Referring to the drawings, a storage container 10 for a paint roller sleeve 50 includes a flexible, resilient, generally cylindrical housing 11 for removably storing the sleeve 50 therein. Sealed on its lower end 12, the housing 11 defines an upper opening 13, which is surrounded by a rim 16 atop sidewall 14. Terminating with the rim 16, the sidewall 14 tapers outwardly to form a funnel that aids in the insertion of the sleeve 50 while it is mounted on the paint roller 51 and keeps paint from dripping outside the container 10.

In the preferred embodiment, a cap 15 snap-fits on the rim 16 to provide an airtight seal. Attached to the cap 15 and to the housing 11 is a strap 23. When the container 10 is closed, the cap-retaining strap 23 is long enough to form a loop that can be used for hanging the container 10 on a pegboard or equivalent for display (FIGS. 2 and 3).

Figure 2:
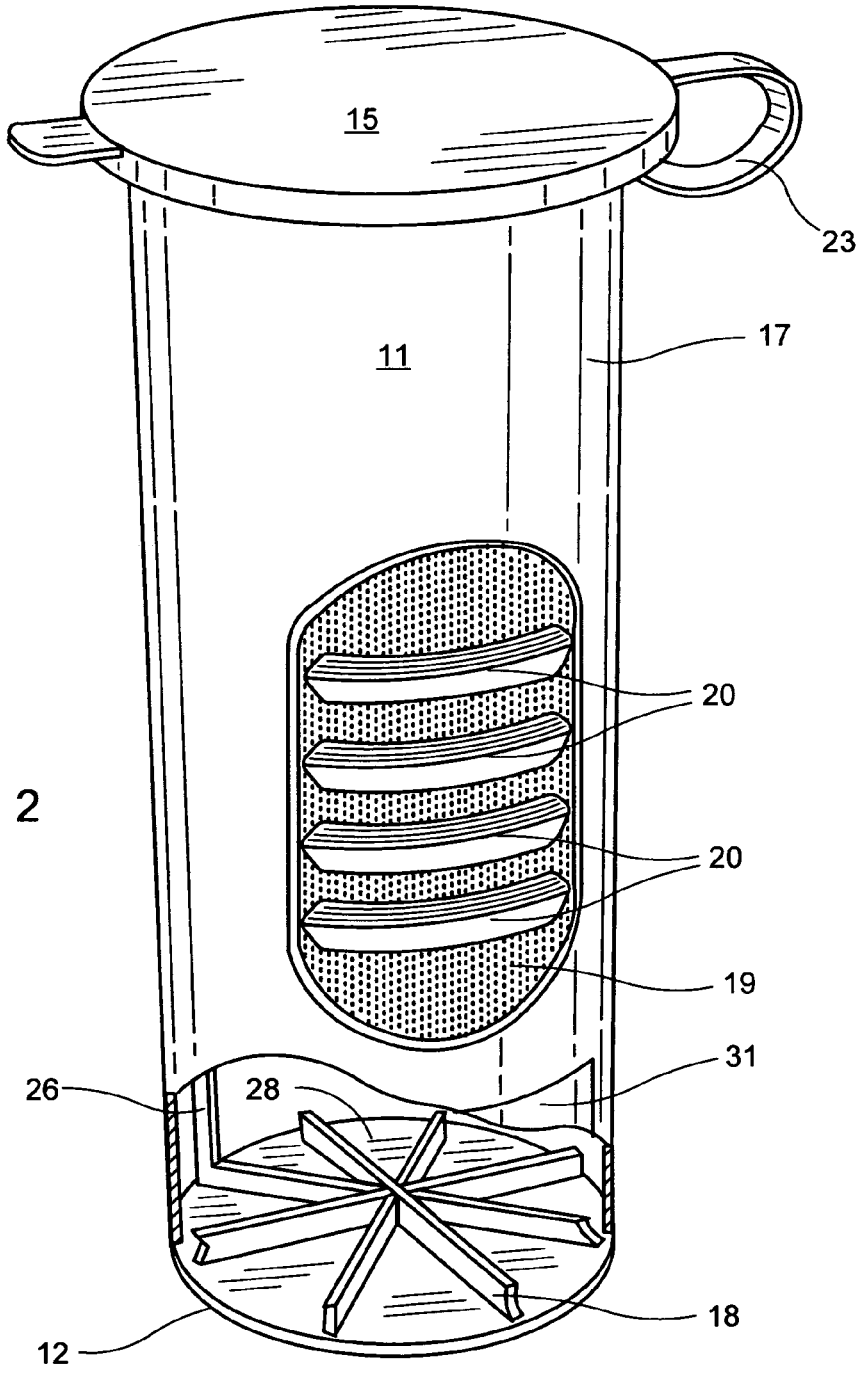
FIG. 2 is a perspective view, on an enlarged scale, of a fragmentary portion of the storage container according to FIG. 1. The storage container being shown empty with its snap-on cap in the closed position, a breakaway section in the lower end of the storage container revealing a standoff disposed therein.

As illustrated in FIG. 2, the container 10 preferably includes a standoff 18 disposed within the housing 11 proximate with its lower end 12. Formed in the shape of a star or similar structure, the standoff 18 keeps the sleeve 50 from resting on the bottom 12 of the container 10 and defines at least one pocket 28. The standoff is formed of ribs 18. The number of ribs can vary and can be four ribs. The pocket 28 fluidly communicates with a reservoir defined by the lower end 12 for capturing any excess paint which drains from the sleeve 50 during storage.

Near the mid-section of the housing 11, at least one pleated wall section 19 made from a hinge-type plastic includes an array of ridges and grooves 20. In the preferred embodiment, two pleated wall sections 19 are disposed on opposing sides of the housing 11 (FIGS. 1-3). The ridges and grooves 20 move inwardly when the opposing wall sections 19 are gripped by the user and squeezed together firmly, together the ridges and grooves 20 form a series of teeth-like projections 21 which hold the sleeve 50 in place while the sleeve is being stripped off of the roller frame 51. In use, a painter simply holds the handle of the roller 51 with one hand and while gripping the wall sections 19 so as to press them against the sleeve as it is being held within the container 10, pulls the sleeve off of the roller. Thus the sleeve 50, once inserted into the container 10, can be removed from the roller 51 without soiling the painter's hands.

Figure 3:
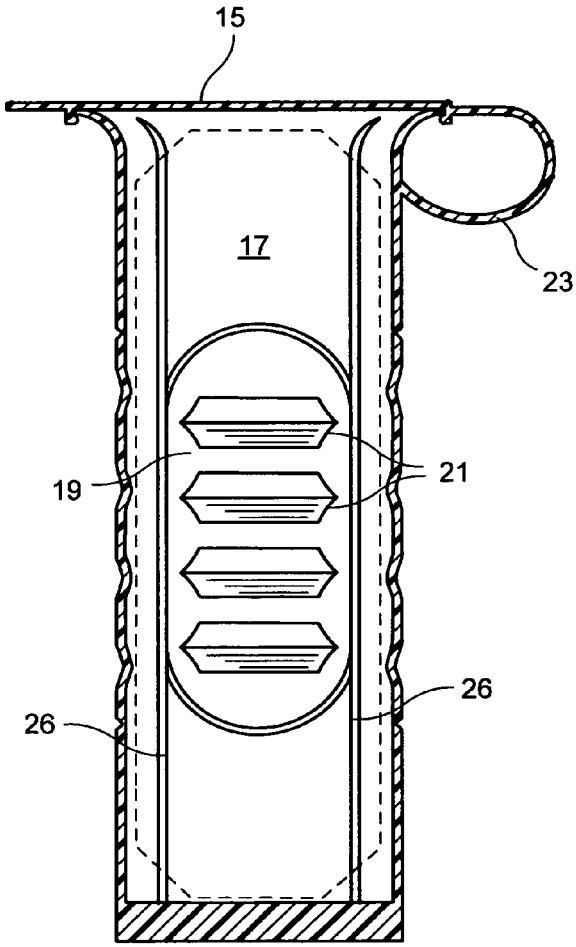
FIG. 3 is a cross-sectional view taken along line 3-3 of FIG. 4.
Figure 4A:
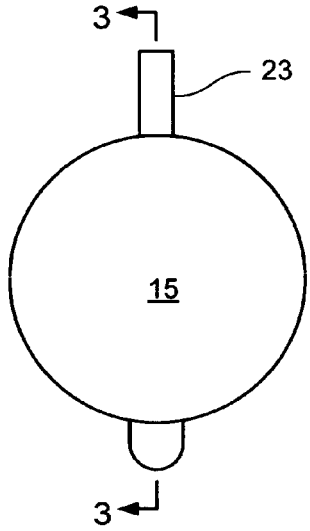
FIGS. 4A and 4B are top plan views of the storage container according to FIG. 1 with its snap-on cap in the closed and open positions, respectively.
Figure 4B:
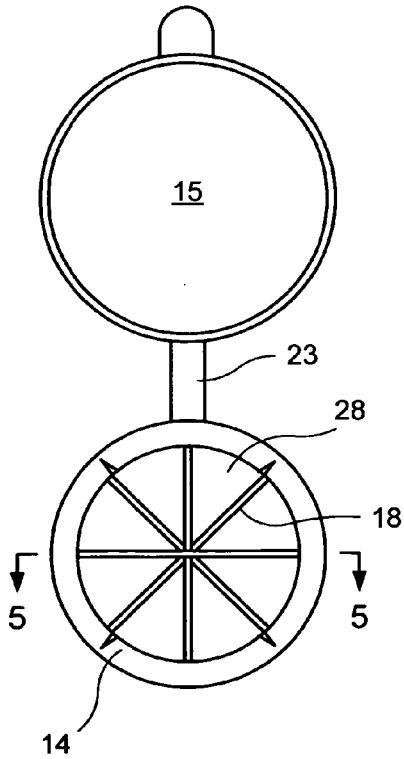
Figure 5:
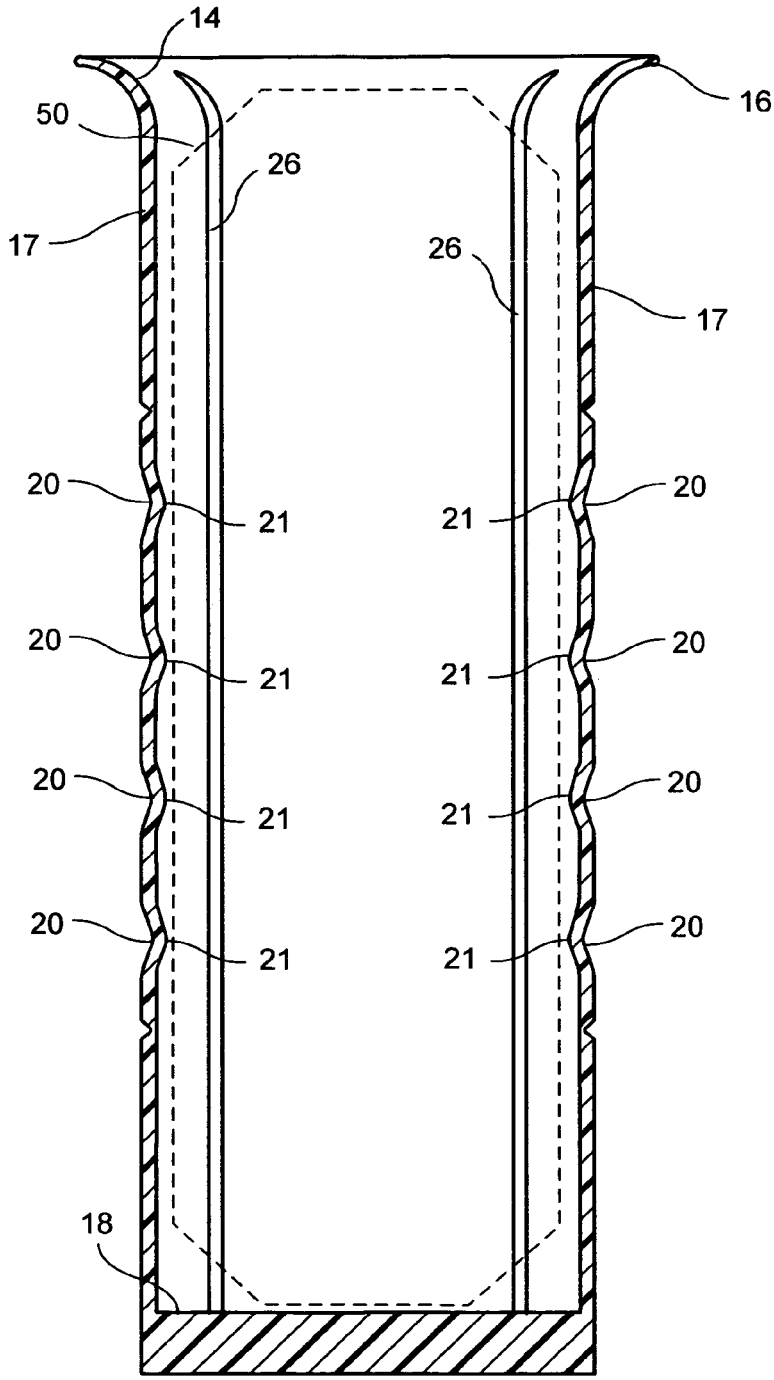
FIG. 5 is an enlarged cross sectional view taken along lines 5-5 of FIG. 4B showing the teeth-like projections of the opposing collapsible wall which when squeezed together, press the teeth-like projections against the sleeve, gripping it; the sleeve being shown in dashed lines.

Means for centering the roller cover 50 in the housing 11 includes a plurality of longitudinal ribs 26, which protrude inwardly from the inner surface of the sidewall 17 (FIGS. 2 and 3). The ribs 26 also facilitate the extraction of the roller cover 50 from the roller 51 when the pleated wall section 19 is pressed.

In the preferred embodiment, an identification patch 31 made by sandblasting a portion of the outer surface of the sidewall 17 or on the top surface of the cap 15 would provide information such as date of the paint job, color of the paint used and job name such as kitchen, bedroom, etc. for the painter's convenience. Sandblasting permits a marker to be used for writing on the sandblasted surface of the container or lid.

So that the open cap 15 can be held out of the way, the strap 23 defines a pair of notches (not shown), and a latch (not shown) is attached to the sidewall 17. When a portion of the strap 23 defining the notches is snap-fitted into the latch, the cap 15 is held against surface 17.

The container 10 measures, by way of example, about 9¾ inches in length and has inner diameters of about 2⅞ inches and 3 7/16 inches proximate with the closed end 12 and rim 16, respectively. A suitable wall thickness for the sidewalls 14, 17 ranges from approximately 0.007 inch to 0.062 inch; and the pleated wall section 19 preferably is about 2 inch wide and 4-112 inches long. The cap-retaining strap 23 is preferably 2-112 closed. The loop so formed can be used to hang the container 10 from a pegboard.

Figure 6:
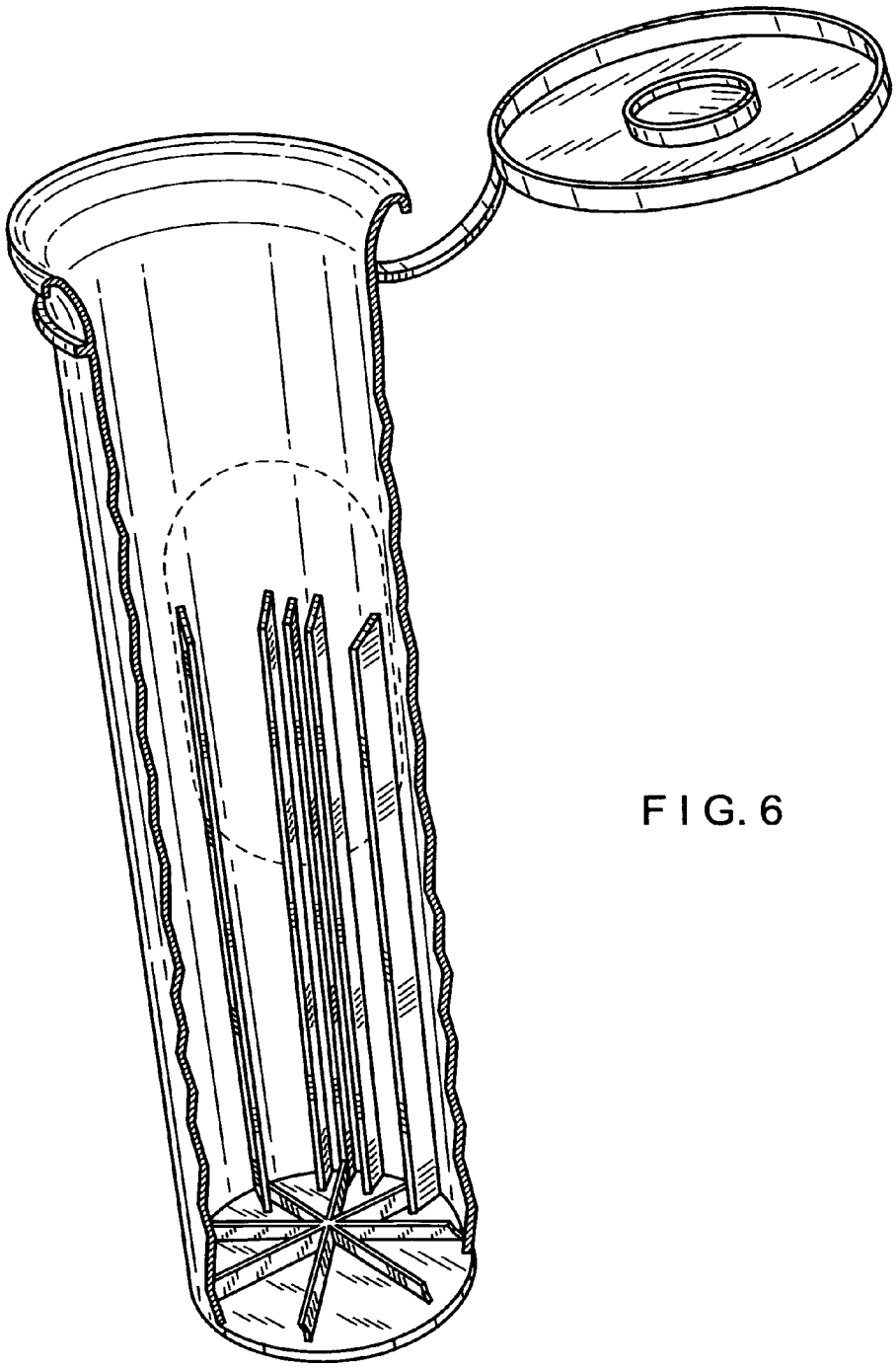
FIG. 6 is a second embodiment of the present invention showing flutes on the opposing collapsible wall which when squeezed together, press the center flute projections against the sleeve, and flexing the two outer flutes on each side of the center flute about the sleeve gripping and centering the sleeve; the outside of the grip being shown in dashed lines.

Referring now to FIG. 6, FIG. 6 shows a second embodiment of the present invention in which the container again has two pleated sections on the outside or exterior surface areas of the container. A set of flutes **26*a* are located on the interior sides of each area where the pleated sections are located. Each set of flutes 26*a* has a plurality of flutes 26*a* that extend preferably from bottom of the container to approximately 55 percent upward along a longitudinal axis of the container. Each set of flutes 26*a* include preferably three interior flutes and two exterior flutes, each exterior flute being located on opposite sides of the interior three flutes. The interior three flutes include a center flute that is set back a distance from the other two interior flutes that flank the center flute one each side. Preferably the center flute is set back approximately ⅛ of an inch. The top surface of each flute 26*a* has preferably a 45° tapered angle to better facilitate the insertion of a roller cover into the cylinder as the angled edges of the flutes serve to more smoothly guide the roller cover into the cylinder. All five flutes 26*a*** serve on each side of the cylinder serve to stabilize the small diameter roller coves and stop the roller covers from rattling within the cylinder and causing the lid of the container to open and lose its airtight seal.

When pressure is applied on the pleated sections of the cylinder the three center flutes on cylinder bend into the cylinder. The 45 degree angle becomes a sharper angle and cuts into or "bites" into the roller nap, holding the roller cover in place while the roller frame or handle is extracted. The center flute, by being set back ⅛ inch, hits the core of the roller cover at its apex and the other two center flutes spread outward slightly to each side of the roller cover's core's center as they come onto contact with the roller cover. The flutes **26*a*** are thus able to hold the roller cover in place while the roller frame is extracted.

In another embodiment, a reservoir is provided in the bottom surface of the cylinder for excess paint to be collected therein. The reservoir (not shown) is located under the standoff or ribs 18 and 15 similar to the reservoir 61 located on the lid as shown in FIG. 6.

In another embodiment, a reservoir has a circularly raised shape at the center bottom of the cylinder matching the circumference of standard sized roller covers. The reservoir preferably but not limited to an approximately ½ inch depth to accommodate excess paint. The raised circumference helps to prevent or restrict excess paint from the roller cover that drips into the existing reservoir from passing across the center. As a result paint will not be able to rise up into the core of roller cover housed in the container.

The present invention permits a user to use the same roller frame 51 with different roller covers 50. After storing away a first roller cover 50 in the cover 10 as described above, the roller frame 51 can then be attached to another roller cover 50 perhaps to be used for a different colored paint than was used for the first roller cover 50. Afterward the second roller cover can be stored away in another container 10 and the first roller cover can reattached to the roller frame 51 to perhaps apply a second coat of paint.

The present invention also permits the container 10 to be turned up or down to more easily disburse and distribute the paint over the roller cover 51 housed therein.

Figure 7:
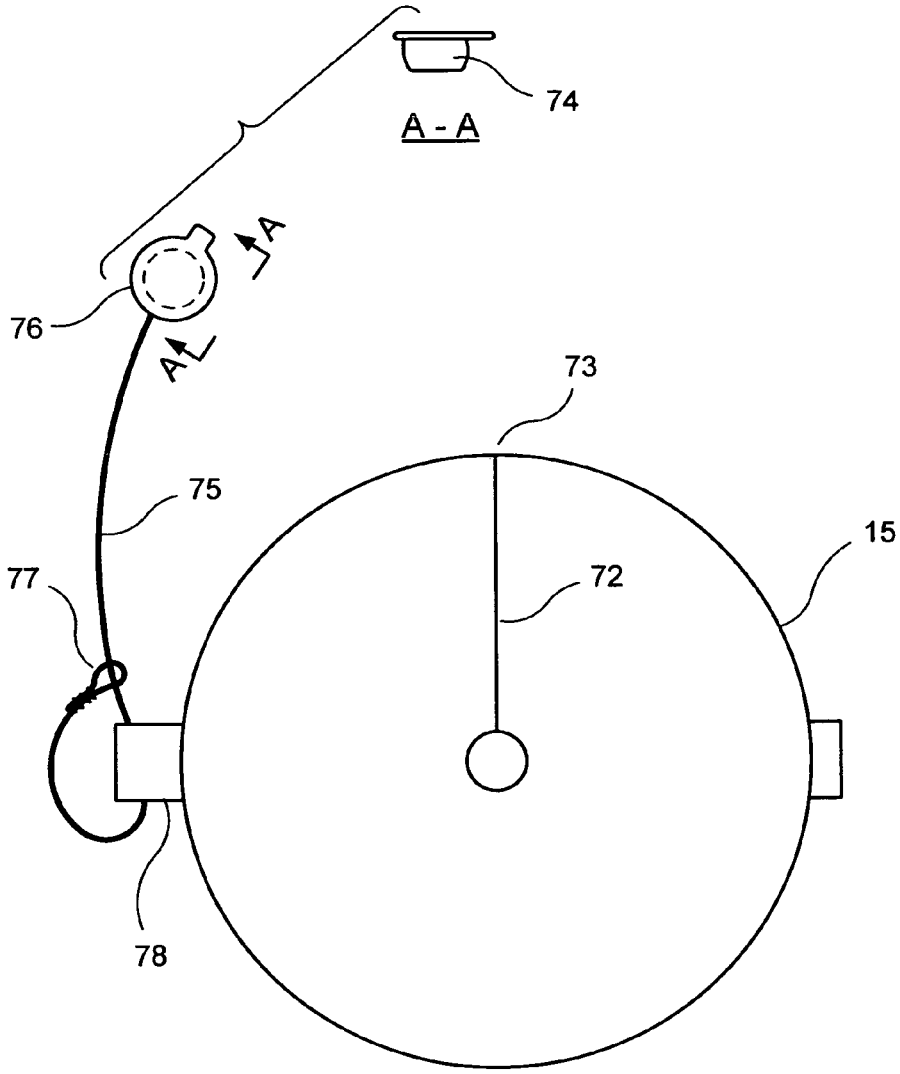
FIG. 7 is another embodiment for the present disclosure showing a modification to the lid of the container in which the lid of the container has a hole in its center and a slit that extends radially to the circumferential edge of the lid to permit the roller frame to remain attached to the roller sleeve when the roller sleeve is housed inside the container. A strap holds at one end a plug for insertion into the hole in the center of the lid and at the other end of the strap a hinge fastens the strap to the lid.

FIG. 7 illustrates another embodiment of the present disclosure. In FIG. 7 the lid has an opening or hole 71 with a radially extending slit 72 that extends from the hole 71 to a circumferential edge 73 of the cap or lid 15. The slit 72 permits the roller frame 51 to stay attached to the roller sleeve 50 when it is inside the container with the roller frame extending out of the hole and slit from the container 10. A plug 74 can seal the hole 71 and the plug 74 is fastened to a strap 75 at one end 76. The other end 77 of the strap 75 can be secured to a hinge 78 on the lid as shown in FIG. 7. In this way, it is possible to keep the roller frame 51 attached to the roller sleeve while it is housed inside the container 10.

Figure 8:
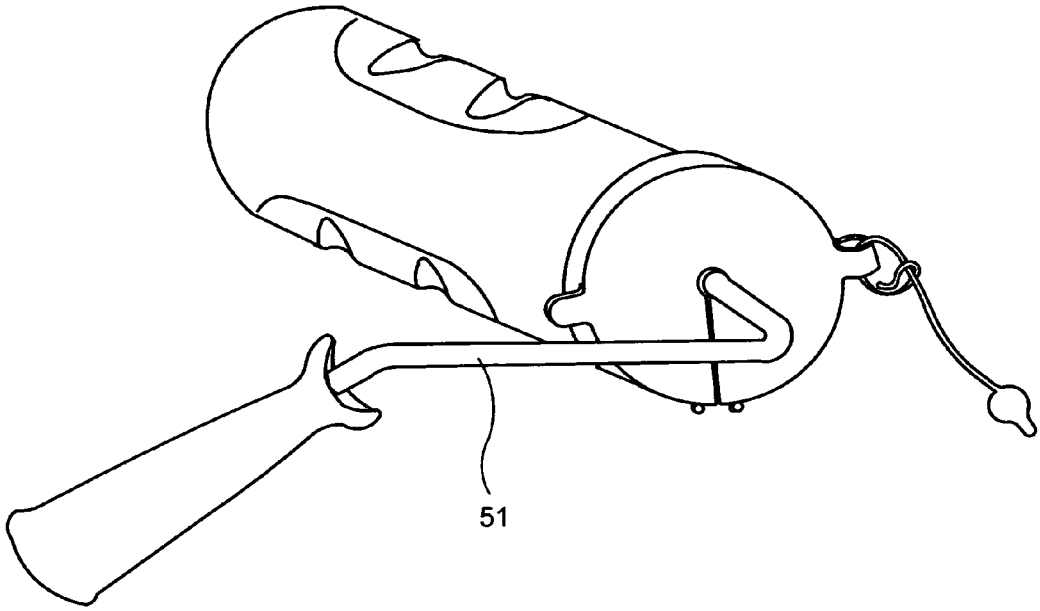
FIG. 8 illustrates the roller frame and the modified lid in accordance with the embodiment of FIG. 7 of the present disclosure.

FIG. 8 shows the roller frame 51 and the modified lid in the embodiment of FIG. 7.

Figure 9:
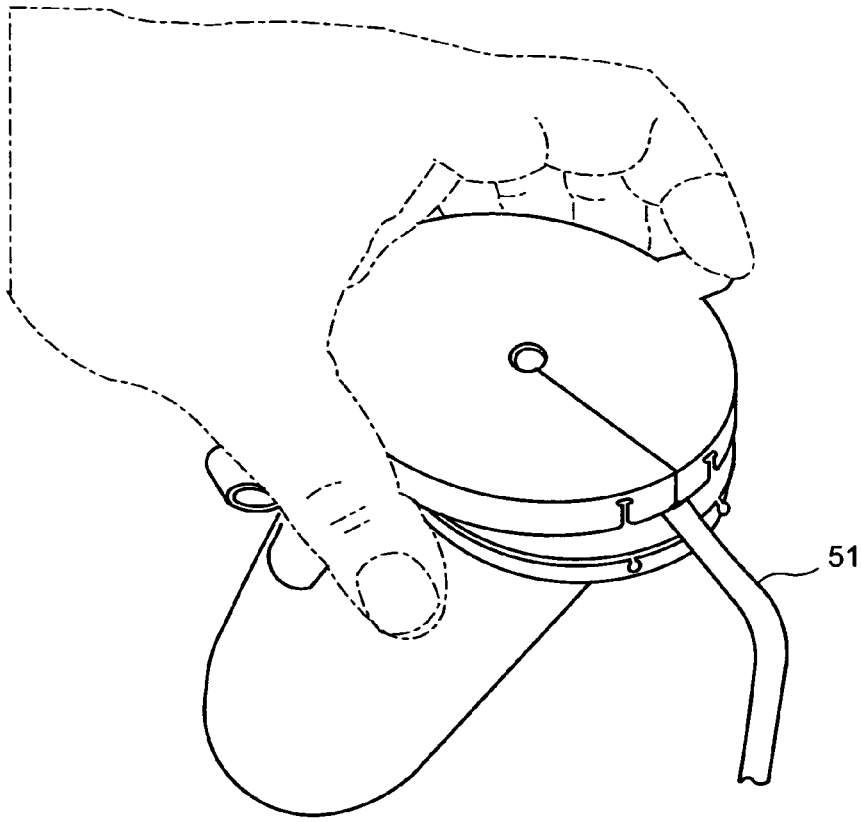
FIG. 9. illustrates the embodiment of FIG. 7 with the lid closed and the roller frame attached to the roller sleeve extending from the hole and slit of the lid.
Figure 10:
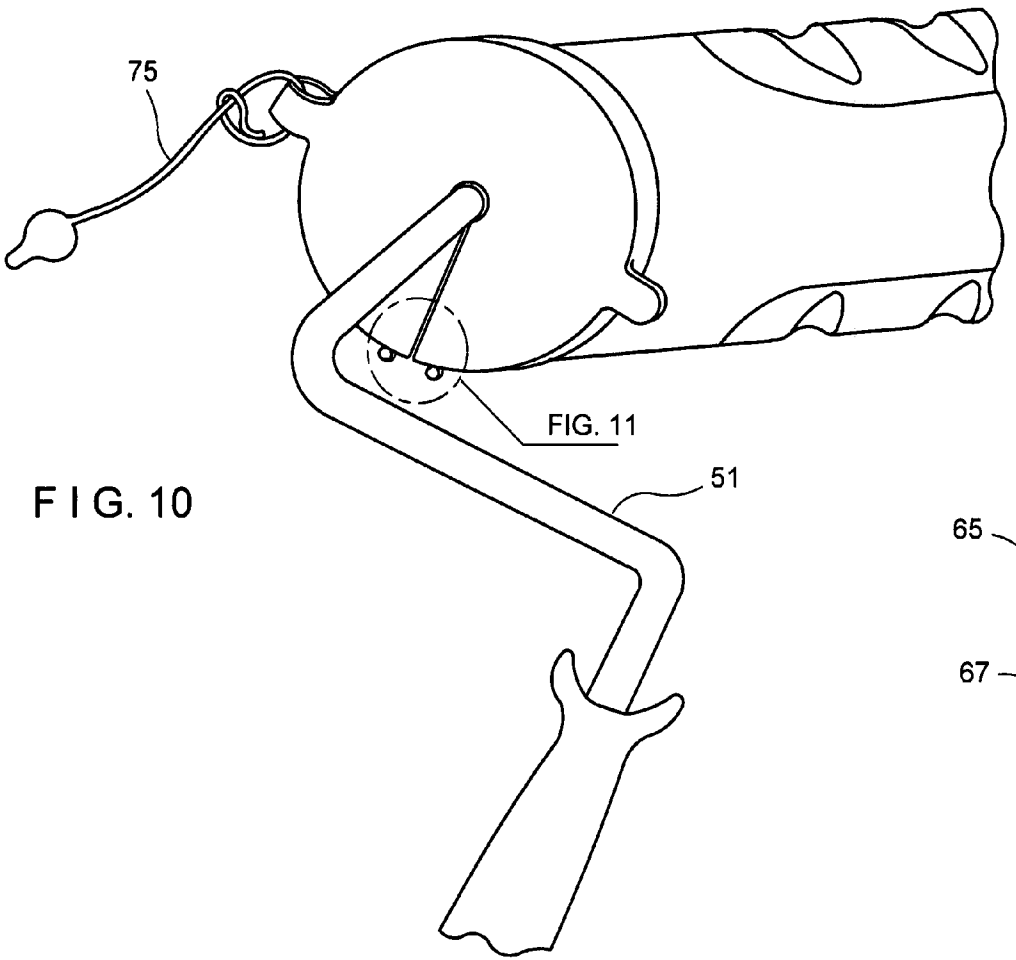
FIG. 10 illustrates the embodiment of FIG. 7 showing the strap attached to the hinge and the roller frame extending out of the lid.
Figure 11:
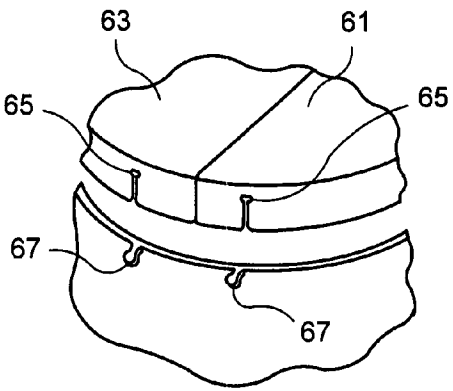
FIG. 11 shows the slots and complimentary barbs for securing the two sides of the lid on opposing sides of the slit that serves to close the lid in place to prevent paint from spilling out and to keep the paint fresh by preventing air from getting into the container.
Figure 12:
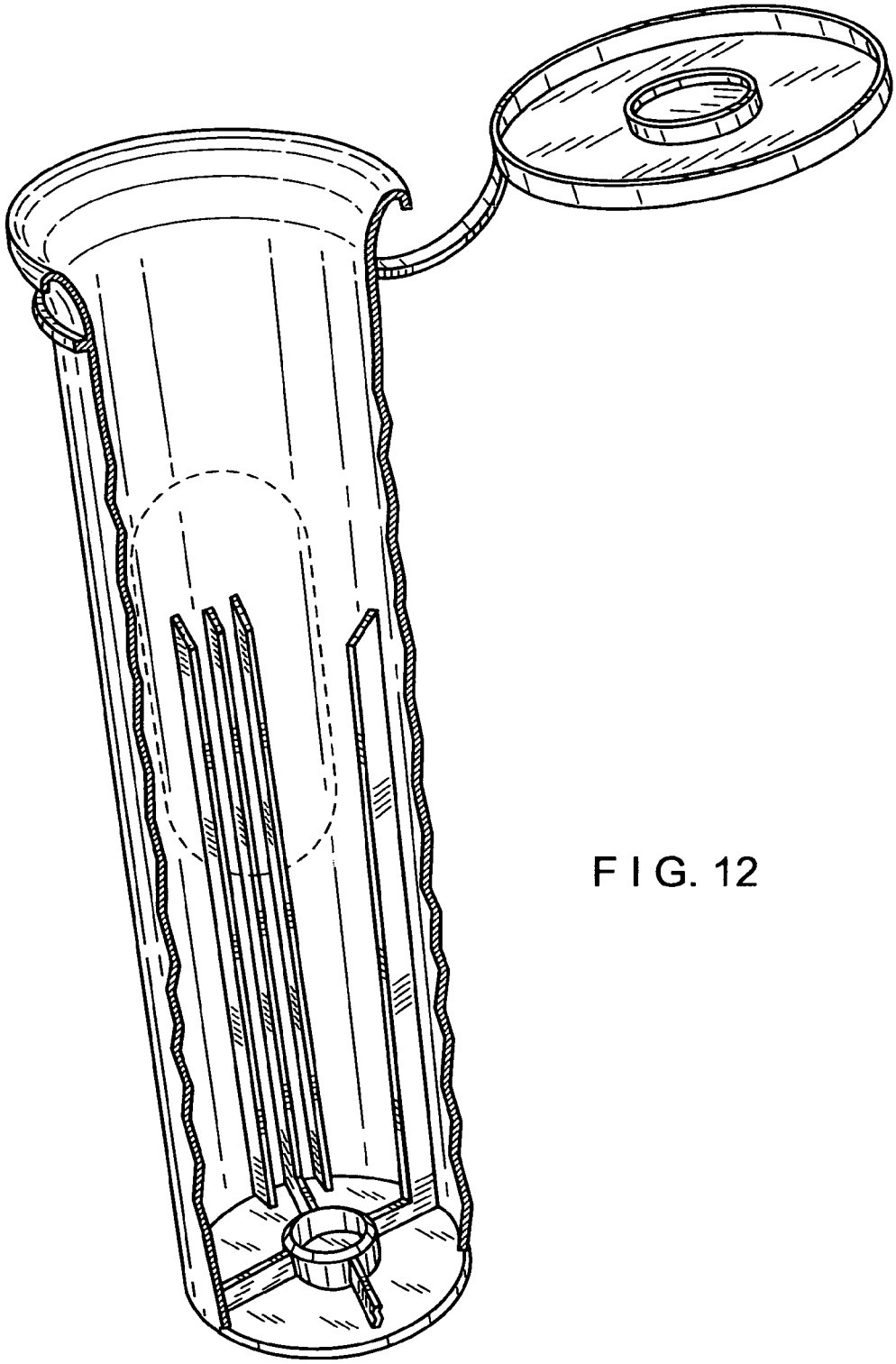
FIG. 12 shows a sectional view of another embodiment of the present invention.

FIG. 9 shows the embodiment of FIG. 7 with the lid closed and the roller frame 51 attached to the roller sleeve 50 extending from the hole and slit of the lid;

FIG. 10 illustrates the embodiment of FIG. 7 showing the strap attached to the hinge and the roller frame 51 extending out of the lid;

In FIG. 11 slots 61 and complimentary barbs 62 are provided for securing the two sides 63, 64 of the lid on opposing sides of the slit that serves to close the lid in place to prevent paint from spilling out and to keep the paint fresh by preventing air from getting into the container.

While the above describes the preferred embodiment of the invention, it is possible that other embodiments thereof may be made by those skilled in the art that fall within the scope of the following claims.

What is claimed:

1. A storage container for paint roller sleeve, comprising:

(a) a flexible, resilient tubular housing for removably storing the sleeve there within;

(b) the tubular housing including a centrally disposed chamber and a sealed end which defines a reservoir for holding excess paint; distal from the sealed end, the housing terminating in an enlarged funnel-like opening for facilitating insertion of the sleeve into the chamber; and (c) a set of flutes on at least two opposing sides of an interior surface of said cylinder for stabilizing a roller cover in place from rattling inside of said housing and for holding said roller cover in place when extracting a roller frame from said roller cover; and (d) a sealing cap removably attachable to the housing proximate with the opening, said sealing cap having an opening in its proximate center and slit radially extending from the hole to a circumferential edge of the cap to provide a access for a roller frame to be remain attached to the roller sleeve while it is housed in said housing with said roller frame extending through said slit, 1 wherein slots and complimentary barbs secure the two sides of the lid on opposing sides of the slit to seal the slit closed to prevent paint from spilling out and to keep the paint fresh by preventing air from getting into said container, further comprising a first slot and a first barb secure one side of two sides of the lid to the container and a second slot and a second barb secure another side of said two sides of the lid to the container and lid to seal the slit of the lid closed tight, said slits and said barbs being configured wherein said first and second barbs fold up upward from a side of said container and matingly fit within said first and second slits of said lid so that said roller frame remains attached to said roller sleeve while housed within said housing when said lid is on said housing.

2. The storage container according to claim 1 further comprising a strap having two ends, and a plug fastened to one end, said plug being adapted for insertion into said opening of said lid, said strap having another end fastened to a hinge connected to said cap.

3. The roller storage container according to claim 1 wherein an interior middle flute is set back approximately ⅛ inch from said two other interior flutes.

4. The container according to claim 1 wherein said flutes each have an angled top surface to facilitate insertion of a paint sleeve into said container.

5. The container according to claim 4 wherein said angled top surface of each of said flutes is approximately 45°.

6. The container according to claim 1 wherein said container has a bottom interior surface that includes a reservoir for collecting paint dripped from a paint cover.

7. The container according to claim 1 wherein said container includes a bottom surface that includes a reservoir formed as a reservoir having a circularly raised shape at a center of said bottom surface of said cylinder and has a circumference that matches a circumference of standard sized roller covers to prevent excess paint that drips into the reservoir from passing across the center so that paint will not rise up into the core of roller cover housed in the container.

8. The container according to claim 7 wherein said circularly raised reservoir has a ½ inch depth.

9. The container according to claim 1 further comprising a sealing cap removably attachable to the housing proximate with the opening.

10. The container according to claim 1 wherein a middle center flute grips into said paint roller cover by cutting onto a nap of said paint roller cover.

* * * * *